United States Patent [19]

Pierson

[11] 4,008,908

[45] Feb. 22, 1977

[54] SNOW SKI BINDING

[76] Inventor: William M. Pierson, 1155 Buff Way, Eugene, Oreg. 97401

[22] Filed: Jan. 13, 1976

[21] Appl. No.: 648,811

[52] U.S. Cl. ..... 280/636; 9/310 AA; 280/607

[51] Int. Cl.[2] ..... A63C 9/00

[58] Field of Search ..... 280/636, 612, 611, 607, 280/609, 600; 9/310 AA, 310 A, 310 B

[56] References Cited

UNITED STATES PATENTS

| | | | |
|---|---|---|---|
| 1,087,745 | 2/1914 | Ellis | 280/600 |
| 1,541,019 | 6/1925 | Youngman | 280/619 X |
| 3,056,148 | 10/1962 | Abbott et al. | 280/609 X |
| 3,934,893 | 1/1976 | Greenleaf | 280/618 X |

*Primary Examiner*—Joseph F. Peters, Jr.
*Assistant Examiner*—Milton L. Smith

[57] ABSTRACT

A two piece snow ski binding which has no movable parts. The subject binding, having no straps or horizontal protrusions, depends solely upon the downward weight of the skier for the capture of the ski boot. Conversely, any upward movement of the skier's boot, or unweighting, allows full release of the boot.

1 Claim, 7 Drawing Figures

SNOW SKI BINDING

BACKGROUND AND SUMMARY OF THE PRESENT INVENTION

This invention relates to a two piece binding referred to as a snow ski binding, which allows skiing with but the use of a single ski. Further, it enables people who are somewhat incapacitated to ski as well, and usually better, than the normal skier using two skis. Use of the present binding on a single ski greatly facilitates teaching of edge control especially helpful to beginners having difficulty understanding the technique of edge control

BRIEF DESCRIPTION OF THE DRAWINGS

The device, which has been briefly discussed in the foregoing, is illustrated in the accompanying drawings, in which.

DETAILED DESCRIPTION OF THE PREFERRED EMBODIMENT

Figure 1:
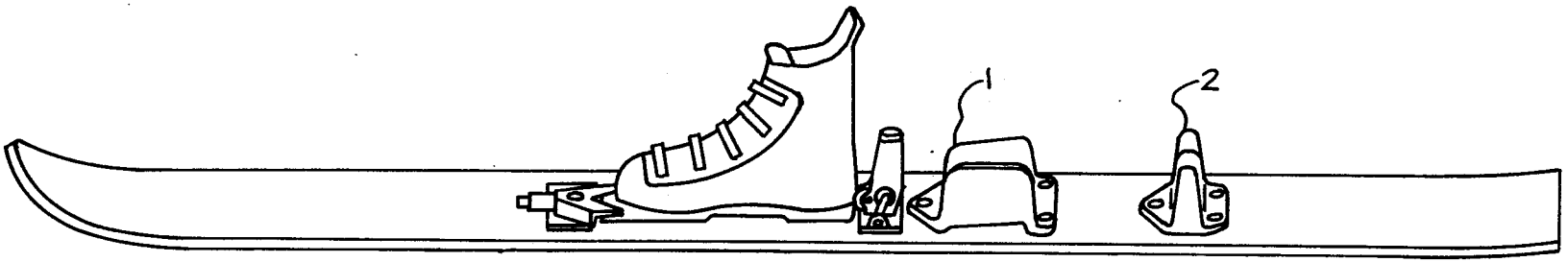
FIG. 1 is a composite of a ski, a ski boot in a regular manufactured binding of any make, and the present two piece ski binding, without boot so it can be seen.

In the following description, reference numerals indicate parts similarly identified in the drawings.

Referring to FIG. 1 of the drawings, two separate pieces 1,2 give the option of installing them at various distances apart for short or long ski boots. Shown in the drawing is the toe piece 1 installed immediately behind the front mounted boot and regular binding and the present heel piece 2 to the rear of the toe piece. All bindings are mounted on the center line of the single ski. Toe piece 1 has a boot supporting surface (FIG. 4) inclined to the ski axis. Neither piece 1 or 2 has any moving parts.

Figure 2:
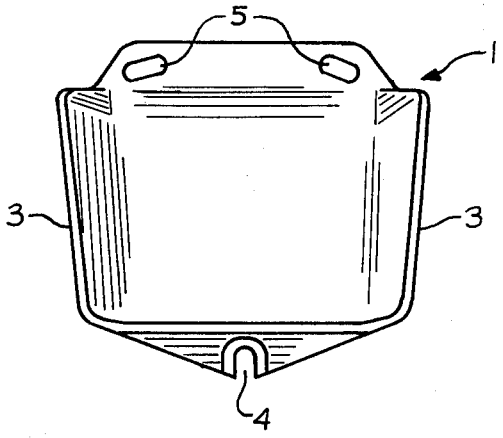
FIG. 2 is a top view of the toe piece of the two piece binding.

Referring to FIG. 2 of the drawings, the two sides 3 of the binding converge toward the front to form a pocket which prevents the ski boot from sliding forward out of the binding. Three screw holes 4,5 are provided for mounting. The front hole 4 is placed in the center and acts as a pivot point during mounting. The two rear holes 5 are slotted to allow a slight swing of the binding either way when mounting, for left or right boot according to the preference of the skier.

Figure 3:
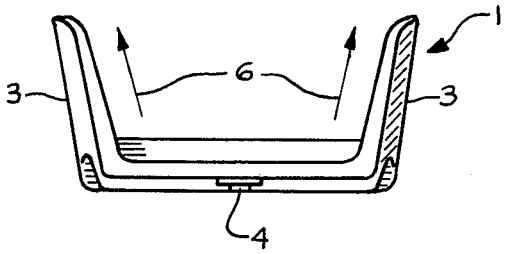
FIG. 3 is a front view of the toe piece of the two piece binding.

FIG. 3 of the drawings shows the upward divergence 6 at the top of upstanding sides 3 to provide ease of ingress and egress of the ski boot. There are no straps or protrusions to hold the boot in since it is essential that the boot can be displaced from the binding at will or when the skier falls. Full capture of the rear boot occurs only when weight is downward on the rear boot.

Figure 4:
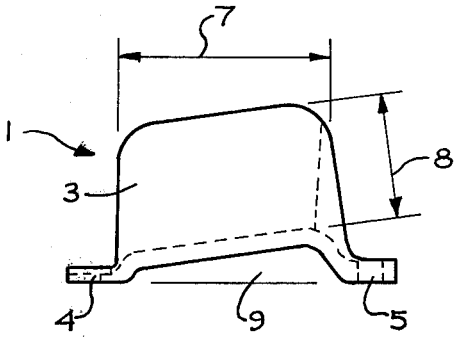
FIG. 4 is a side view of the toe piece of the two piece binding.

FIG. 4 of the drawing shows the horizontal length 7 of the side 3. Considerable length is required for three reasons.

a. Quite severe side-to-side stresses require sufficient material to withstand such stress.

b. Sides of short length proved in tests to create undue abrasions on the sides of boots.

c. Sides of short length would allow the boot to come out sideways if the boot was inadvertantly moved a short distance to the rear. This often happens in rough mogul conditions. The height of the sides 8 was also proved necessary in field tests in rough snow conditions. Shorter sides allowed the boot to bounce out and caused loss of control. The cavity beneath 9 is purely for economy of material and reduction of weight.

Figure 5:
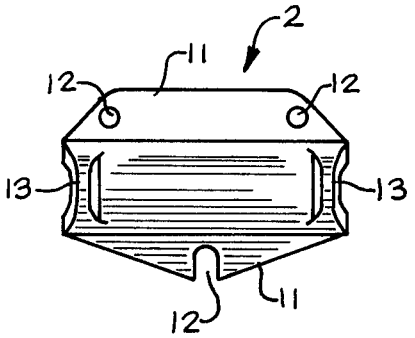
FIG. 5 is a top view of the heel piece of the two piece binding.

FIG. 5 of the drawings shows the bottom mounting flanges 11 of the rear binding piece 2. Three holes 12 have been provided in the flanges for mounting.

Figure 6:
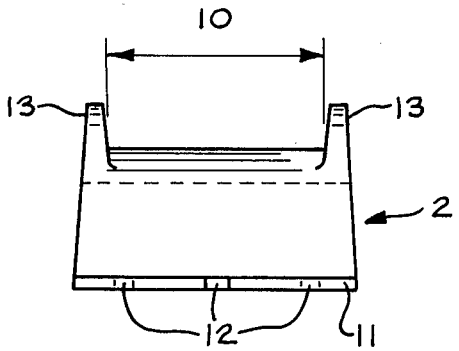
FIG. 6 is a front view of the heel piece of the two piece binding.

FIG. 6 of the drawings shows the width 10 of the rear binding piece 2 that should be a loose fit on the side of the ski boot heel. The ears 13 prevent the heel of the ski boot from slipping sideways and provide the skier a reference so that he knows when his rear boot is proper allignment with his front boot and the ski.

Figure 7:
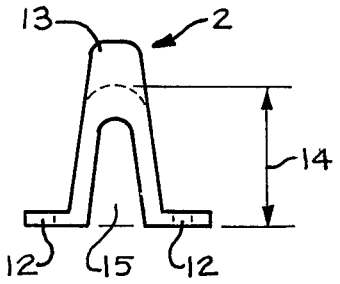
FIG. 7 is a side view of the heel piece of the two piece binding.

Referring to FIG. 7 of the drawings, note that considerable height 14 is provided for the heel of the boot. Both sets of bindings, the regular manufactured binding and the present binding, are mounted on one ski and, as a result, the bottom of the bindings are on a common plane. The skiers front leg becomes the primary leg holding most of the weight, while his rear leg is the secondary leg and is used for balance and directional control of the ski. The natural position of the rear boot on the ski is with the heel raised. Therefore, the height at 14 of the rear piece 2 is necessary to give a stable platform for the rear boot.

What I claim as my Invention is:

1. A ski boot binding for a single snow ski and comprising in combination, a toe piece for attachment to a ski rearwardly of a front mounted binding, said toe piece when attached to the ski having a boot sole supporting surface inclined to the major axis of the ski, said toe piece additionally including sides extending upwardly from opposite sides of the inclined sole boot supporting surface, and a heel piece for attachment to the ski rearwardly offset from the toe piece and having heel supporting surface elevated from the ski, said heel supporting surface substantially coplanar with said inclined boot sole supporting surface of the toe piece with the plane being inclined to said axis of the ski, said heel piece additionally including upstanding ears on opposite sides of said heel supporting surface to confine the heel against lateral movement.

* * * * *